United States Patent [19]

Williams et al.

[11] Patent Number: 4,861,309

[45] **Date of Patent: * Aug. 29, 1989**

[54] SPIRAL CYLINDER TOY

[75] Inventors: D. Michael Williams, New York, N.Y.; Lawrence B. Grubb, Monkton, Md.

[73] Assignee: Johnson & Johnson Consumer Products, Inc., New Brunswick, N.J.

[ * ] Notice: The portion of the term of this patent subsequent to Jan. 19, 2005 has been disclaimed.

[21] Appl. No.: 72,076

[22] Filed: Jul. 10, 1987

Related U.S. Application Data

[63] Continuation of Ser. No. 763,266, Aug. 7, 1985, Pat. No. 4,720,283.

[51] Int. Cl.[4] ..... A63H 33/00

[52] U.S. Cl. ..... 446/168

[58] Field of Search ..... 446/170, 168, 171; 273/109, 110; 220/4 E

[56] References Cited

U.S. PATENT DOCUMENTS

| | | | |
|---|---|---|---|
| 2,487,168 | 11/1949 | Mordkin | 220/4 E |
| 2,752,725 | 7/1956 | Unsworth | 273/109 X |
| 2,931,131 | 4/1960 | Morse | 446/168 |
| 3,028,704 | 4/1962 | Rumbaugh | 446/168 |
| 3,135,512 | 6/1964 | Taylor | 273/109 |
| 4,720,283 | 1/1988 | Williams et al. | 446/168 X |

*Primary Examiner*—Mickey Yu

[57] ABSTRACT

A cylindrical toy having a first and second half each defining a semi-cylindrical body. Each of the halves has secured to its inner surface a plurality of substantially semi-circular flat plates which define a spiral passage when the halves are connected. The cylindrical halves have a bottom portion and the bottom portion of one half includes a bottom guide disk. The second half includes a reinforcing plate which is spaced from and disposed parallel to the bottom portion of the second half to form a space which receives the guide disk of the first half in order to accurately position the two halves with respect to each other prior to their being connected together.

2 Claims, 4 Drawing Sheets

SPIRAL CYLINDER TOY

This is a continuation of application Ser. No. 763,266, filed Aug. 7, 1985, now U.S. Pat. No. 4,720,283.

The present invention relates to a baby's toy, and more particularly, to a toy which arouses baby's attention and which contributes to the promotion and growth of baby's intellectual and physical function.

BACKGROUND OF THE INVENTION

In general, as baby's toys there are known various types such as a sound-producing toy or a toy to play with manually. These toys are so devised variously as to promote baby's intellectual and physical faculty growth. Nevertheless, it is not that this field is always completely satisfied with these conventional toys and a child and his parents are always seeking for something new. Of course, there are some cases where the child soon loses his interest in the toy or breaks it or where the toy is too high-leveled to a child, especially young child.

In the process of the baby's growth, his intellectual and physical abilities are developing through various ability stages.

For instance, the development of the baby's intellectual and physical abilities is promoted by looking at the toy or listening to the sound of the toy or touching the toy. That is, baby gains various unknown experiences through the toys. And from these experiences baby discovers new facts, and repeats them to acquire new knowledge or skills. This enables baby to cultivate an important sense of self-satisfaction. At the same time, a toy develops baby's behavioral abilities to enjoy all by himself or to stimulate himself. Thus, a toy provides the baby with many opportunities to learn about many things while playing. And by attracting the baby's attention to forget himself, the toy can promote the development of his abilities in a synergistically effective way. Accordingly, in order to promote this development effectively it is useful for the toy to comprise any stimulating means to appeal to the baby's instinctive curiosity. And its stimulating means continues to encourage the baby's curiosity to many unknown worlds. As a result, the toy becomes more excellent so long as the baby continues to show his interest in it.

An object of this invention is to provide a baby's toy which can promote his intellectual growth and physical growth effectively by attracting his interest strongly and letting him not lose his interest in the toy.

A further object of the invention is to provide a baby's toy in which baby's action toward things and results thereby are caused to be recognized by vision and audition.

A still further object of this invention is to offer an inexpensive cylindrical body having a nearly spiral passage comparatively easy to manufacture and which is capable of effectively developing baby's intellectual growth, that is, sensing ability or recognition ability and physical ability, that is, rough locomotion or minute motion, by attracting baby's interest, not tiring baby, through letting it watch spheres or beads tumbling down the cylindrical body.

BRIEF DESCRIPTION OF THE DRAWINGS

FIG. 9 is a perspective view of the baby's toy in FIG. 1 and the rings capable of being combined with that.

EXAMPLE

Figure 1:
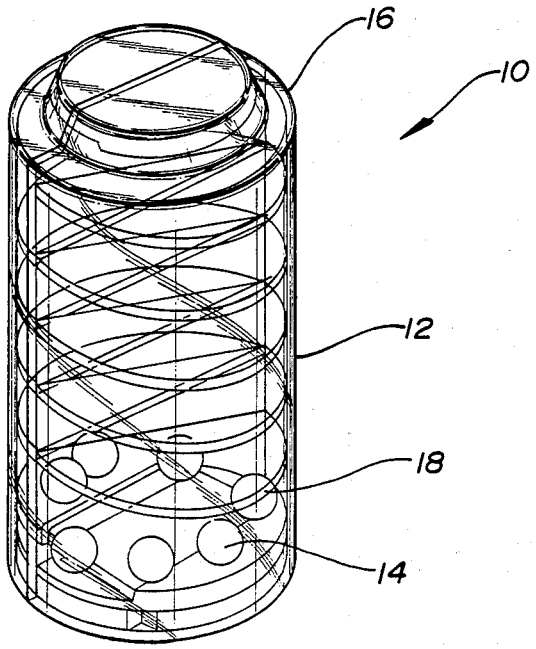
FIG. 1 is a perspective view of a baby's toy according to one example of the present device.
Figure 2:
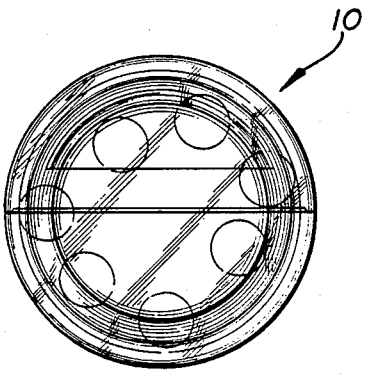
FIG. 2 is a plan view of the baby's toy in FIG. 1.
Figure 3:
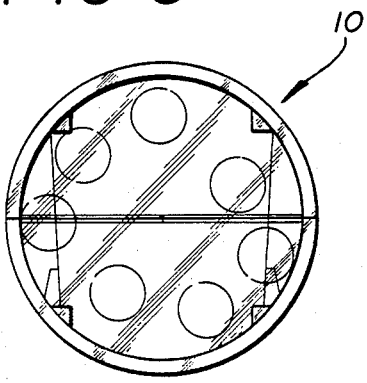
FIG. 3 is a bottom view of the baby's toy in FIG. 1.
Figure 4:
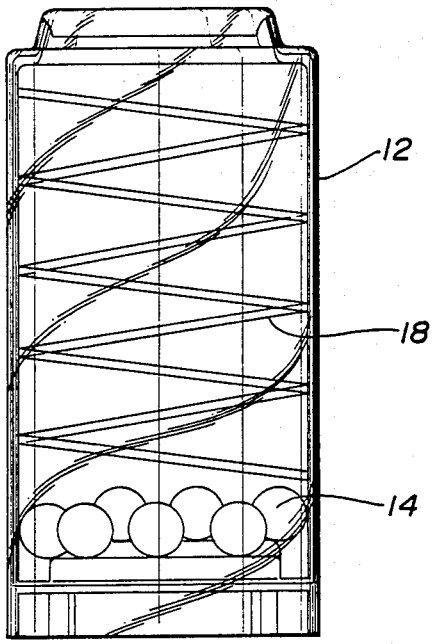
FIG. 4 is a front view of the baby's toy in FIG. 1.
Figure 5:
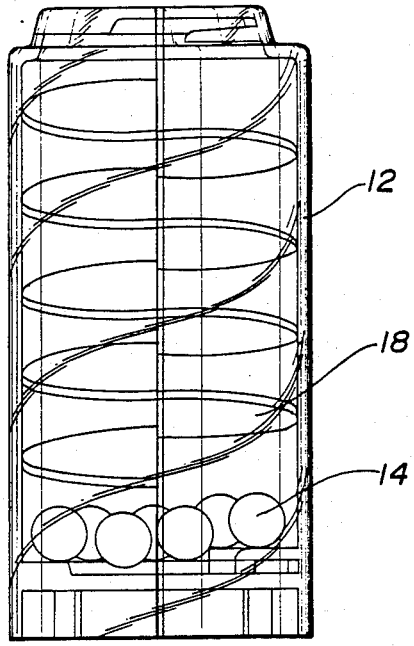
FIG. 5 is a right side view of the baby's toy in FIG. 1.
Figure 6:
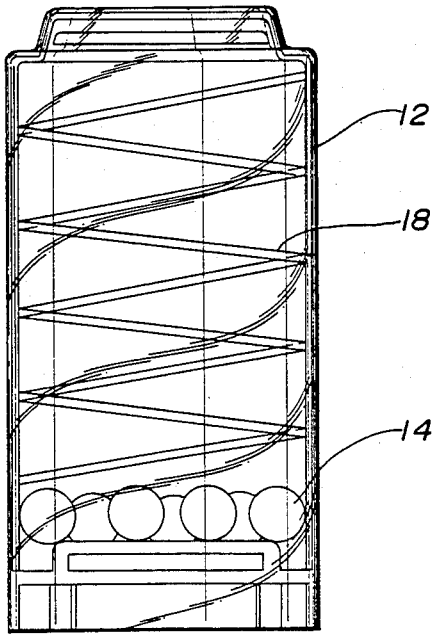
FIG. 6 is the back view of the baby's toy in FIG. 1.
Figure 7:
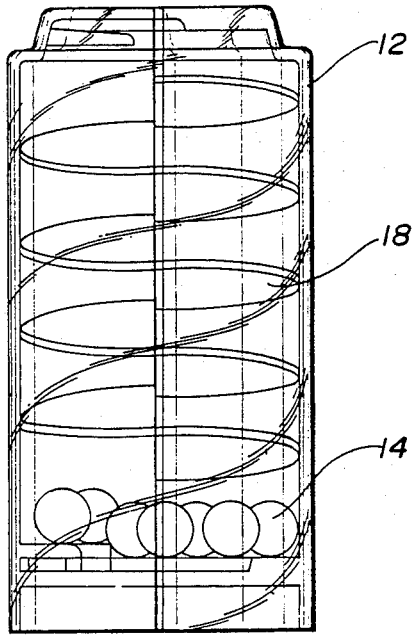
FIG. 7 is a left side view of the baby's toy in FIG. 1.

Then with reference to FIGS. 1 to 9, the desirable example of the present invention will be described below.

A baby's toy 10 according to this Example is provided with a cylindrical body 12 and a plurality of spheres or beads 14.

The cylindrical body 12 includes a transparent tubular body 16 and a plurality of nearly semicircular flat plates 18.

Figure 8:
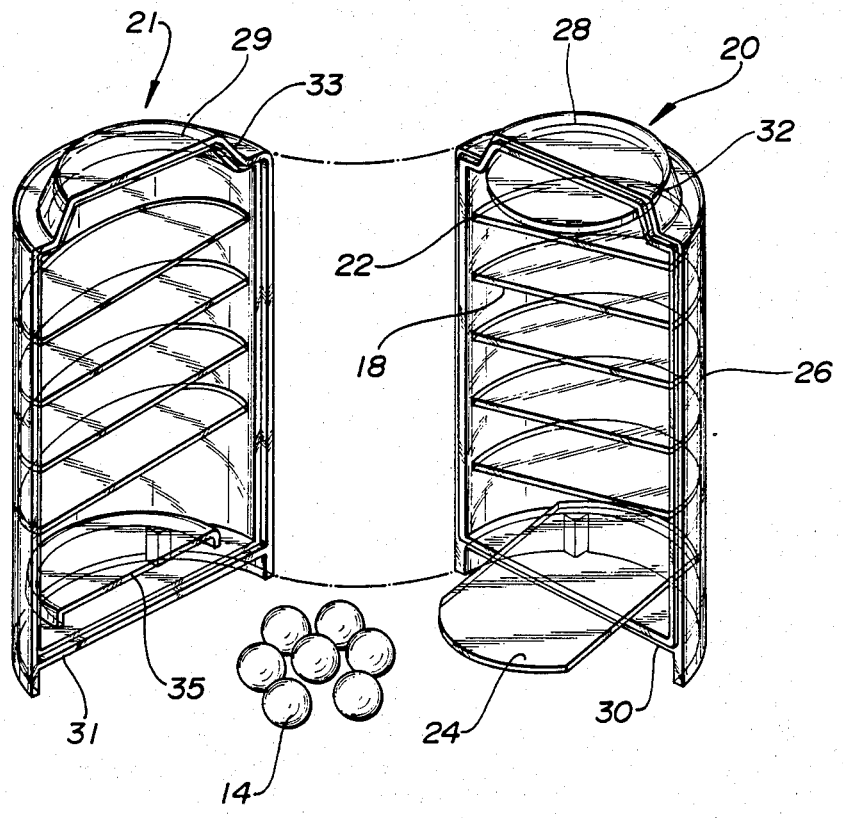
FIG. 8 is a perspective view showing the state of the disassembly of the baby's toy in FIG. 1.

The transparent tubular body 16 includes two halves 20 and 21, a top guide disk 22, and a bottom guide disk 24, the halves 20 and 21 having respectively a side portion 26, a top portion 28 and a bottom portion 30 (FIG. 8).

The semicircular outer periphery of the plurality of semicircular flat plates 18 is fixed to the inner wall of the side portion 26 of the half 20. The plane of the flat plate 18 is arranged to be inclined to the cross section of the tubular body 16 (That is, to a plane perpendicular to the vertical central axle of the tubular body 16 in FIGS. 4–7). As is clarified in FIG. 8, the inclined directions are the same respectively in each of the halves 20 and 21, but in reverse between the halves 20 and 21. By this, when the tubular body 16 is formed by the connection of the halves 20 and 21, a spiral passage becomes possible.

The top portions 28 and 29 of the halves 20 and 21 have concaves 32 and 33 that fit into the top guide disk 22.

To the bottom portion 30 of one half 20 is fixed the bottom guide disk 24 whose both sides are notched. The bottom portion 31 of the other half 21 has a reinforcing plate 35 to form a concave to accommodate the bottom guide disk 24.

Hence, for example, as in FIG. 8, the top guide disk 22 is fixed to the concave 32 of the top portion 28 of the other half 20 with an adhesive, and the bottom guide disk 24 is fixed to the bottom portion 30 of the other half 20. Then, with an adhesive the two halves 20 and 22 are connected to each other integrally.

The two halves 20 and 21 can be accurately positioned and very steadily connected to each other with the help of the top guide disk 22 and the concaves 32, 33, and the bottom guide disk 24 and the reinforcing plate 35.

In the above example, the plurality of nearly semicircular flat plates 18, the halves 20 and 21, the top guide disk 22 and the bottom guide disk 24 are prepared with separate materials and they are connected with an adhesive, but, for example, the flat plates 18, the half 20 and the top and bottom guide disks 22 and 23 can be formed by an integral molding, and the flat plates 18 and the half 21 can be molded integrally.

And in the above Example, all of the members of the cylindrical body 12 are of transparent material, but, for example, only the side portion 26 of the halves 20 and 21 may be prepared with transparent material.

Figure 9:
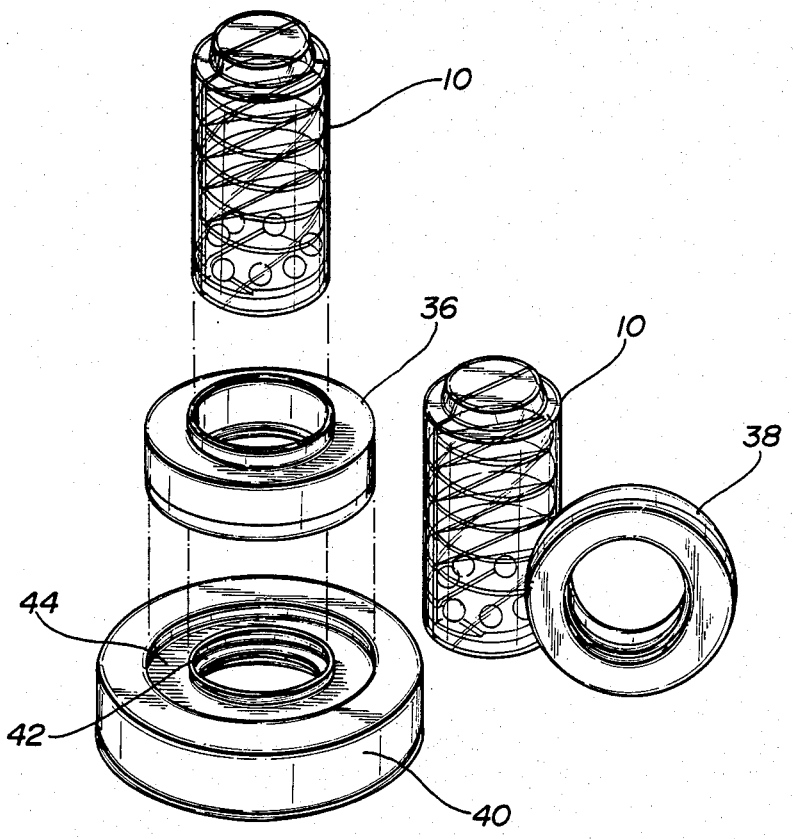

As is shown in FIG. 9, a baby's toy in the present device can be played with in combination with rings 36, 38, 40. The first and second rings 36, 38 have inside diameters nearly equal to the outside dimension of the baby's toy 10 and are meant to accommodate the baby's toy of the present device. The third ring 40 is provided with a first seat 42 to stack the baby's toy 10 of the present device on and a second seat 44 to stack the first or second ring 36, 38 on.

Further, it is desirable that the first and second rings 36, 38 be hollow and rattle with hard small pieces placed inside when the first and second rings are shaken.

Since the baby's toy of the present device is constructed as above when baby plays with this toy and turns it over, the spheres or beads tumble down the spiral passage. Since the tubular body is formed with transparent material, baby can watch the spheres or beads from the outside, and moreover, since the spiral passage is particularly made of flat plates, sound is caused when the spheres or beads tumble down. For this, baby can recognize the fall of the spheres or beads by vision and audition.

What is claimed is:

1. In a cylindrical toy comprising a first half and a second half, each of said halves having a top portion, a side portion, and a bottom portion, and each of said halves having secured to their respective inner surfaces a plurality of substantially semi-circular flat plates which, when said halves are connected, define a spiral passage in the interior of said cylindrical toy, the improvement wherein the bottom portion of said first half includes a bottom guide disk and the second half includes a reinforcing plate spaced from and disposed parallel to the bottom portion of said second half whereby said halves may be accurately positioned with respect to each other prior to their being connected together.

2. A cylindrical toy according to claim 1 wherein said first half further includes a top guide disk.

* * * * *